US006167937B1

(12) United States Patent
Williams

(10) Patent No.: US 6,167,937 B1
(45) **Date of Patent: *Jan. 2, 2001**

(54) SEAL SETTING MECHANISM

(75) Inventor: Charles E. Williams, Delavan, WI (US)

(73) Assignee: Hufcor, Inc., Janesville, WI (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/132,793

(22) Filed: Aug. 13, 1998

(51) Int. Cl.[7] ..... E06B 7/18
(52) U.S. Cl. ..... 160/40; 49/321; 52/243.1
(58) Field of Search ..... 160/40, 351; 52/243.1, 52/64; 49/321

(56) References Cited

U.S. PATENT DOCUMENTS

| | | | | |
|---|---|---|---|---|
| 33,640 | * | 11/1861 | Fischel . | |
| 464,078 | * | 12/1891 | Mcghee | 49/321 |
| 994,142 | * | 6/1911 | Forsyth | 49/321 |
| 1,063,345 | * | 6/1913 | Forsyth | 49/321 |
| 1,376,350 | * | 4/1921 | Neumann et al. | 49/321 |
| 1,799,232 | * | 4/1931 | Henderson et al. | 49/321 |
| 2,187,459 | * | 1/1940 | Lorenz | 49/321 |
| 3,068,936 | | 12/1962 | Haws | 160/40 |
| 3,295,257 | | 1/1967 | Douglass | 49/317 |
| 3,295,588 | | 1/1967 | Gilson | 160/199 |
| 3,341,992 | * | 9/1967 | Piper | 52/243.1 |
| 3,374,821 | | 3/1968 | White | 160/40 |
| 3,450,185 | | 6/1969 | Holloway | 160/199 |
| 3,802,480 | | 4/1974 | Daggy | 160/40 |
| 4,014,137 | | 3/1977 | Williams | 49/321 |
| 4,277,920 | | 7/1981 | Dixon | 52/64 |
| 4,535,578 | | 8/1985 | Gerken | 52/243.1 |
| 5,339,881 | | 8/1994 | Owens | 160/40 |
| 5,481,834 | * | 1/1996 | Kowalczyk et al. | 160/40 |

* cited by examiner

*Primary Examiner*—Blair M. Johnson
(74) *Attorney, Agent, or Firm*—Michael Best & Friedrich LLP

(57) ABSTRACT

A seal setting mechanism is provided that includes a pair of cross-members and a pair of downwardly extending force transfer members. The cross-members are linked with a linking member. When the cross-members are pivoted downwardly, the force is transferred through the force transfer members to a spring associated with each force transfer member. The spring applies a force on a sealing member. The sealing member is thus pressed against the floor, and held in place by the springs.

19 Claims, 6 Drawing Sheets

SEAL SETTING MECHANISM

FIELD OF THE INVENTION

The invention relates to seal setting mechanisms for partition walls.

BACKGROUND

Partition walls are used for dividing convention halls into smaller meeting rooms. Typically the partition walls comprise several panels that are moved along a track mounted on the ceiling of the convention hall until the panels are in the desired location. Each panel is fixed in place, preferably with a seal between the panel and the floor. Once set up, the seal resists lateral forces applied to the partition wall.

Prior art seal setting mechanisms require the operator to lift a lever to cause pressure members to engage the floor. Some prior art sealing devices require a slot or groove, or a series of holes, to be provided in the floor of the room to further secure the panels to the floor.

SUMMARY

The present invention provides a seal setting mechanism for a partition wall panel. The seal setting mechanism includes an upper cross-member and a lower cross-member. The upper cross-member is pivotally interconnected with the panel at the leading edge, and the lower cross-member is pivotally interconnected with the panel at the trailing edge. A linking member interconnects the upper cross-member with the lower cross-member.

A long rod is pivotally interconnected with the upper cross-member and extends down to the bottom edge of the panel. A short rod is pivotally interconnected with the lower cross-member, and extends downwardly from the lower cross-member to the bottom edge of the panel. A sealing member is interconnected with the lower ends of the long and short rods.

The upper cross-member is pivoted downwardly, thereby causing the lower cross-member to also pivot downwardly. The long and short rods are thereby driven downwardly, pressing the sealing member against the floor.

In one aspect of the invention, a spring assembly is provided with each of the long and short rods. The spring assembly includes a foot tube having a spring plate welded therein. The long and short rods pass through the spring plate. Springs surround the long and short rods, and compress against the spring plate as the long and short rods are driven downwardly. After the desired amount of spring compression has been achieved, the upper cross-member is locked in place, and the sealing member is biased against the floor to provide a seal.

DETAILED DESCRIPTION

Figure 1:
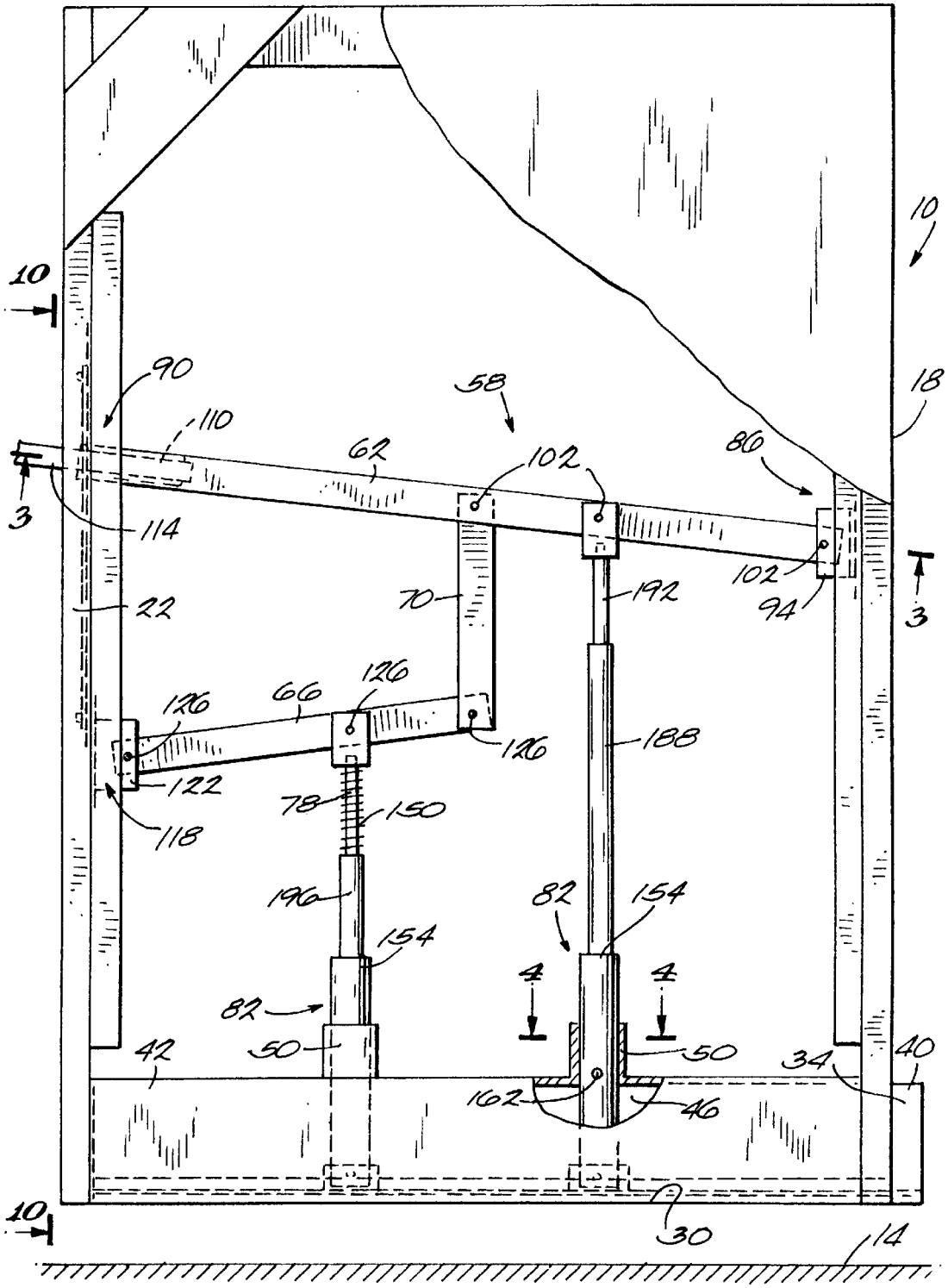
FIG. 1 is a side elevational view of a partition wall panel including the seal setting mechanism of the present invention in the up position.
Figure 10:
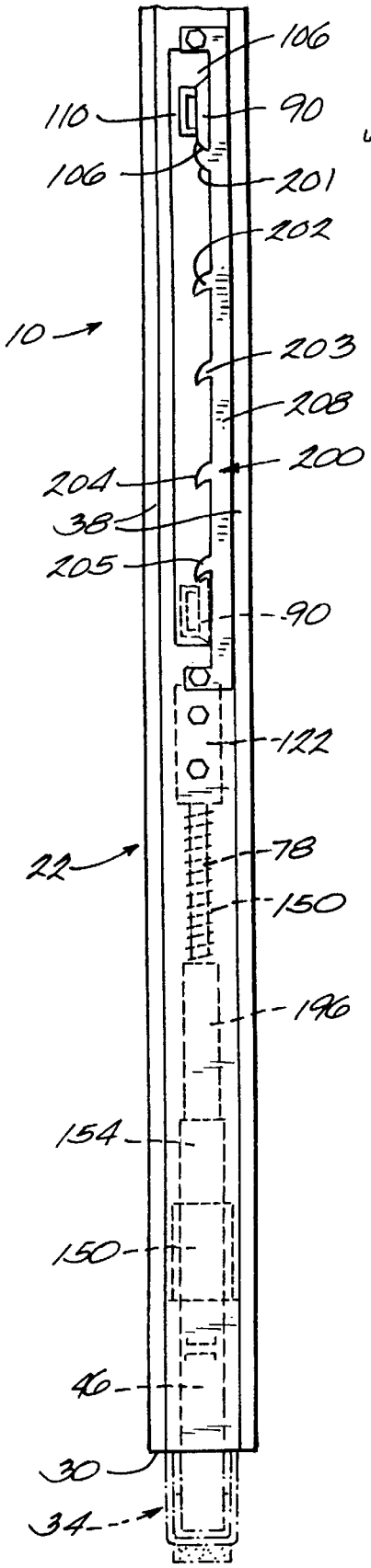
FIG. 10 is a view taken along line 10—10 in FIG. 1.
Figure 9:
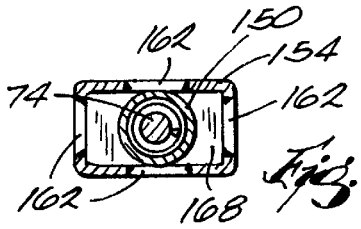
FIG. 9 is a cross-section view taken along line 9—9 in FIG. 6.

FIG. 1 illustrates a partition wall panel 10 suspended over the floor 14 of a convention hall or other room. The panel 10 is suspended from a track (not shown) mounted on or formed in the ceiling of the room. A partition wall may be constructed from a plurality of these panels 10. The panel 10 is independently movable along the track. Each panel 10 includes a substantially vertical leading edge 18, a substantially vertical trailing edge 22, and a bottom edge 30 extending between the leading and trailing edge 18, 22. A sealing member 34 is operatively interconnected with the panel 10 adjacent the bottom edge 30, as explained in more detail below. The sealing member 34 is preferably made of metal (e.g., aluminum or steel) with soft vinyl gaskets, but other materials may be substituted, such as a composite material. Each panel 10 also includes a pair of spaced-apart side walls 38 (FIG. 10). The leading edge 18 of each panel 10 is designed to mate with the trailing edge 22 of the panel next to it to ensure a snug fit between the panels 10. To that end, the leading edge 40 of the sealing member 34 provides a male portion, and the trailing edge of the panel provides a female portion 41 (FIG. 2), into which the male portion of the adjacent panel 10 is inserted.

Figure 4:
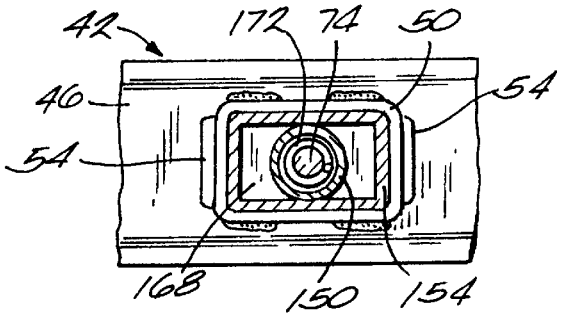
FIG. 4 is a cross-section view taken along line 4—4 in FIG. 1.

A bottom rail 42 is provided adjacent the bottom edge 30 of the panel 10. The bottom rail 42 includes a generally U-shaped channel 46 (FIG. 10) that opens downwardly, and a pair of guide tubes 50 welded or fastened to the channel 46. Flanges 54 (FIG. 4) may be provided on the guide tubes 50 to further stabilize the guide tubes 50 on the channel 46. Apertures are formed in the channel wall 46 such that the guide tubes 50 are in fluid communication with the channel 46. The sealing member 34 is disposed within the channel 46 for movement with respect to the channel 46. In this regard, the channel 46 acts as a guide for the sealing member 34.

Figure 2:
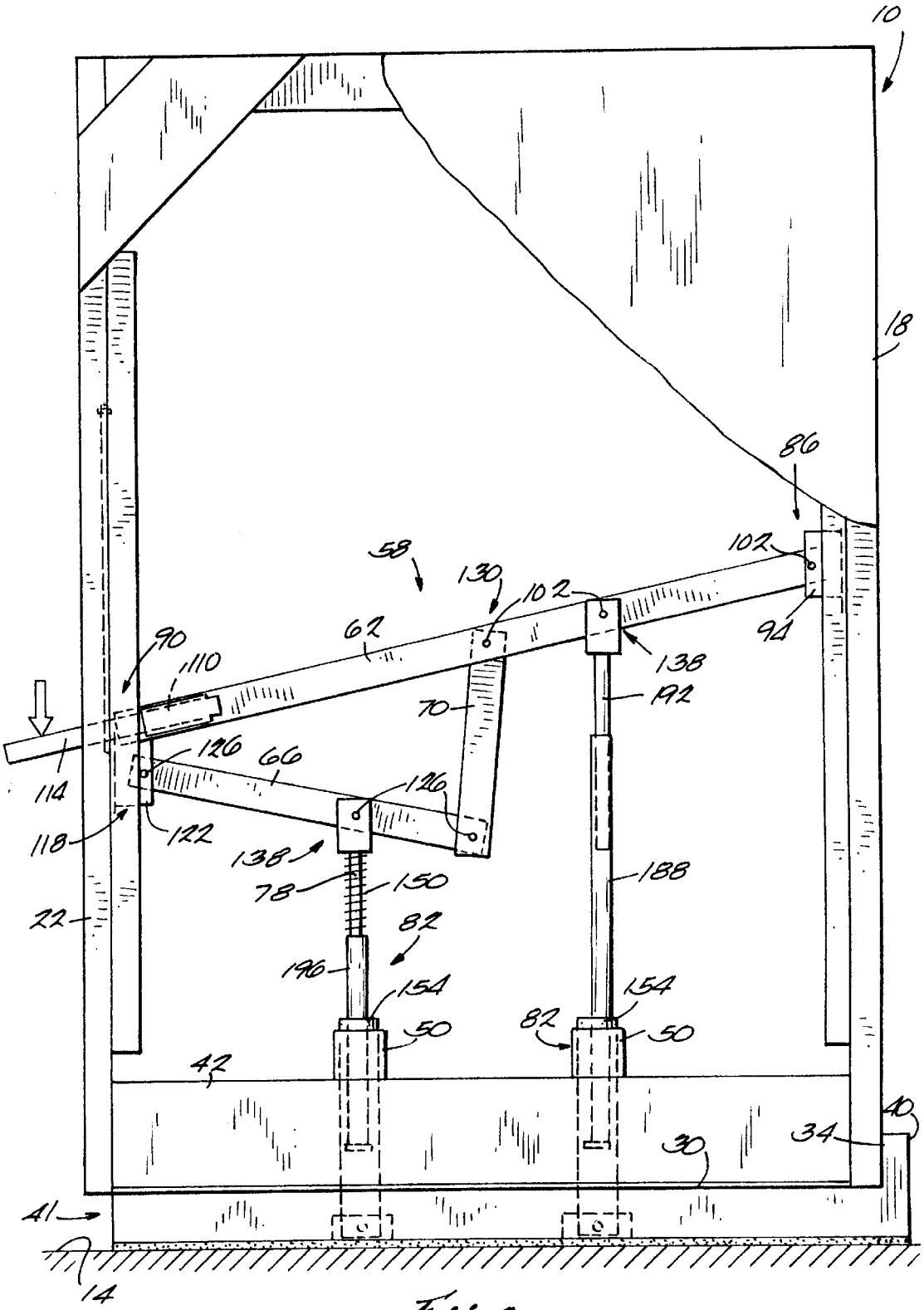
FIG. 2. is a side elevational view of a partition wall panel with the seal setting mechanism in the down position.

A seal setting mechanism 58 is disposed in each panel 10 between the side walls 38. Referring to FIGS. 1 and 2, the illustrated sealing mechanism 58 generally includes an upper cross-member 62, a lower cross-member 66, a linking member 70, a long rod 74 (FIG. 8), a short rod 78, and a pair of spring assemblies 82. As described below in more detail, the seal setting mechanism 58 is used to create a seal between the sealing member 34 and the floor 14 by applying a downward force on the sealing member 34. In alternative embodiments, the seal setting mechanism 58 may include a single cross-member and a single rod and spring assembly. Such alternative embodiments may be particularly useful in thin partition wall panels (e.g., where the leading and trailing edges 18, 22 are relatively close to each other).

The upper cross-member 62 is pivotally interconnected with the panel 10 at an upper cross-member pivot point 86 adjacent the leading edge 18. The upper cross-member 62 extends substantially entirely across the panel 10, and has a free end 90 adjacent the trailing edge 22. An upper cross-member mounting bracket may be used to provide the upper cross-member pivot point 86. One suitable mounting bracket is an angle bracket 94 (FIG. 3) having two through-holes in one portion for mounting the angle bracket 94 to the panel 10 with fasteners 98, and a one-half inch hole in the other portion through which a pin is extended to pivotally mount the upper cross-member 62 to the angle bracket 94.

The illustrated upper cross-member 62 is a ⅜ inch thick steel bar having three drilled holes of approximately one-half inch diameter. The three holes receive pivot pins 102 that pivotally connect the upper cross-member 62 to the upper cross-member mounting bracket, the long rod 74, and the linking member 70. The hole that receives the linking member pivot pin 102 is located substantially halfway between the ends, or in the middle, of the upper cross-member 62.

Figure 3:
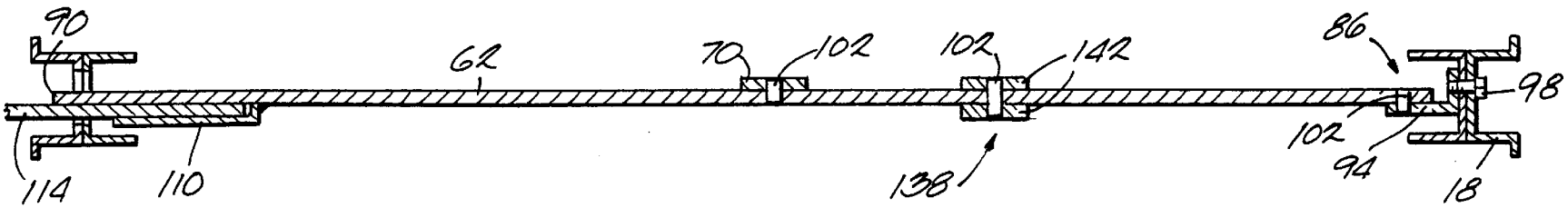
FIG. 3 is a cross-section view taken along line 3—3 in FIG. 1.

The illustrated upper cross-member 62 also includes a beveled portion 106 at the free end 90. Mounted or welded on the upper cross-member 62 adjacent the free end 90 is a handle socket 110 (FIGS. 3 and 10). The handle socket 110 is generally C-shaped in cross-section. The handle socket 110 receives a lever 114 that is used to move the seal setting mechanism 58 between an "up" position (FIG. 1) and a "down" position (FIGS. 2) as described below.

The illustrated lower cross-member 66 is pivotally interconnected with the panel 10 at a lower cross-member pivot point 118 adjacent the trailing edge 22. The lower cross-member 66 extends into the panel 10 about halfway between the trailing and leading edges 18, 22. A lower cross-member mounting bracket 122 may be used to provide the lower cross-member pivot point 118. A suitable lower cross-member mounting bracket is an angle bracket that is substantially the same as the one described above for the upper cross-member mounting bracket. The illustrated lower cross-member 66 is a ⅜ inch thick steel bar having three drilled holes of approximately one-half inch diameter. The three holes receive pivot pins 126 that pivotally connect the lower cross-member 66 to the lower cross-member mounting bracket 122, the short rod 78, and the linking member 70.

In alternative embodiments, the upper cross-member 62 and the lower cross-member 66 may be switched, such that the longer cross-member 62 is disposed below the shorter cross-member 66.

The linking member 70 is pivotally interconnected with, and extends between, the upper and lower cross-members 62, 66. The illustrated linking member 70 is a ⅜ inch thick steel bar having a one-half inch diameter hole drilled adjacent each of its ends. The holes receive the pins 102, 126 that provide the linking member pivot points 130.

When the seal setting mechanism is in the up position (FIG. 1), the linking member is tilted from vertical in a first direction. When the seal setting mechanism is in the down position (FIG. 2), the linking member is also tilted in the first direction. When the seal setting mechanism 58 is in between the up and down positions, the linking member passes through a vertically-oriented position. In alternative embodiments, the pivot points between the upper and lower cross-members 62, 66 and the linking member 70 can be moved such that the linking member is substantially vertical when the sealing mechanism is in the up or down position.

Figure 6:
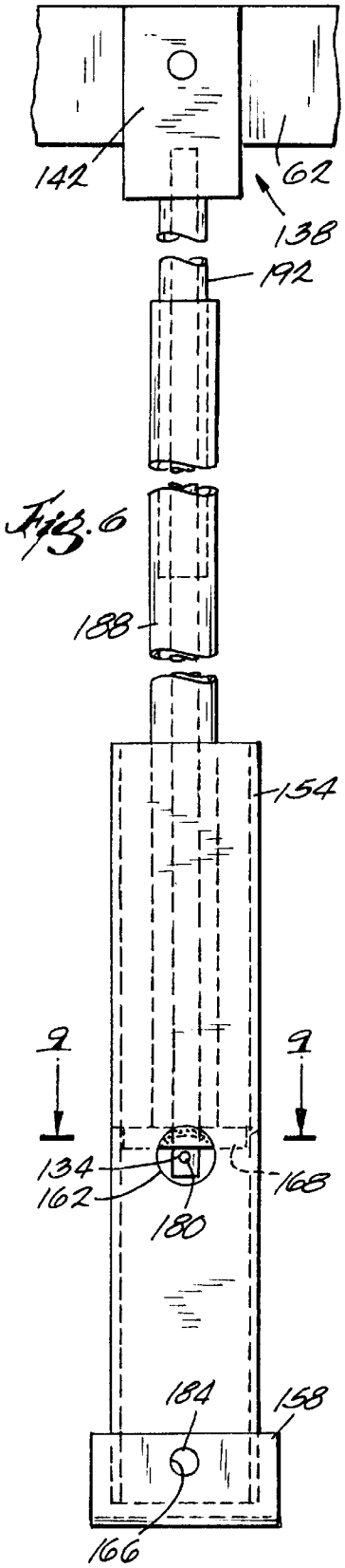
FIG. 6 is a side elevational view of a portion of the seal setting mechanism.
Figure 7:
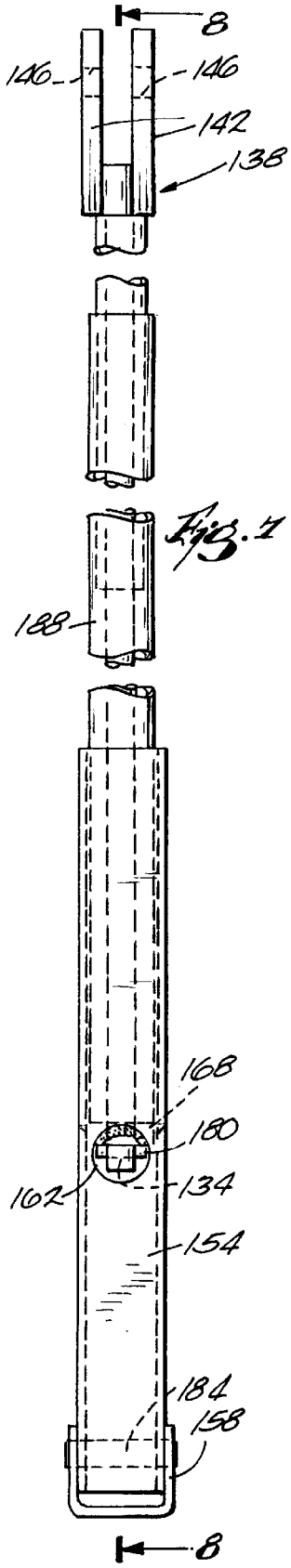
FIG. 7 is a view side elevational view of a portion of the seal setting mechanism.
Figure 8:
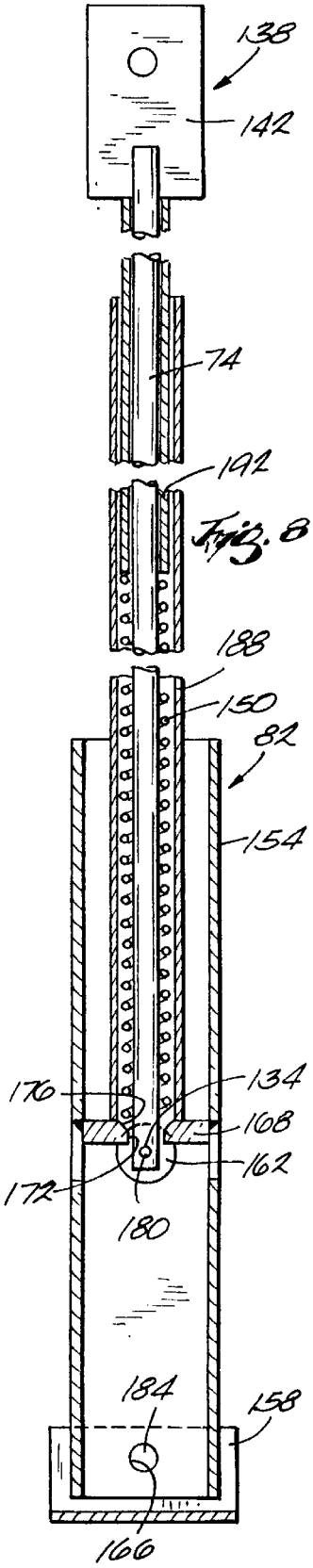
FIG. 8 is a cross-section view taken along line 8—8 in FIG. 7.

Referring to FIGS. 6–8, the long rod 74 is pivotally interconnected to the upper cross-member 62, and extends downwardly therefrom toward the bottom edge 30 of the panel 10. The short rod 78 is pivotally interconnected to the lower cross-member 66, and also extends downwardly toward the bottom edge 30 of the panel 10. The illustrated long rod 74 and short rod 78 are one-half inch diameter steel rods having a 7/32 inch diameter drilled spring pin hole 134 adjacent the lower end (FIG. 7). Mounting brackets 138 may be used to pivotally interconnect the long and short rods 74, 78 to the upper and lower cross-members 62, 66, respectively. The illustrated mounting brackets 138 comprise a pair of rod plates 142 that are welded on opposite sides of the upper end of the long and short rods 74, 78. The illustrated rod plates 142 are ⅜ inch thick steel plates. A one-half inch hole 146 is drilled through the rod plates 142 to receive the pivot pins 102.

Figure 5:
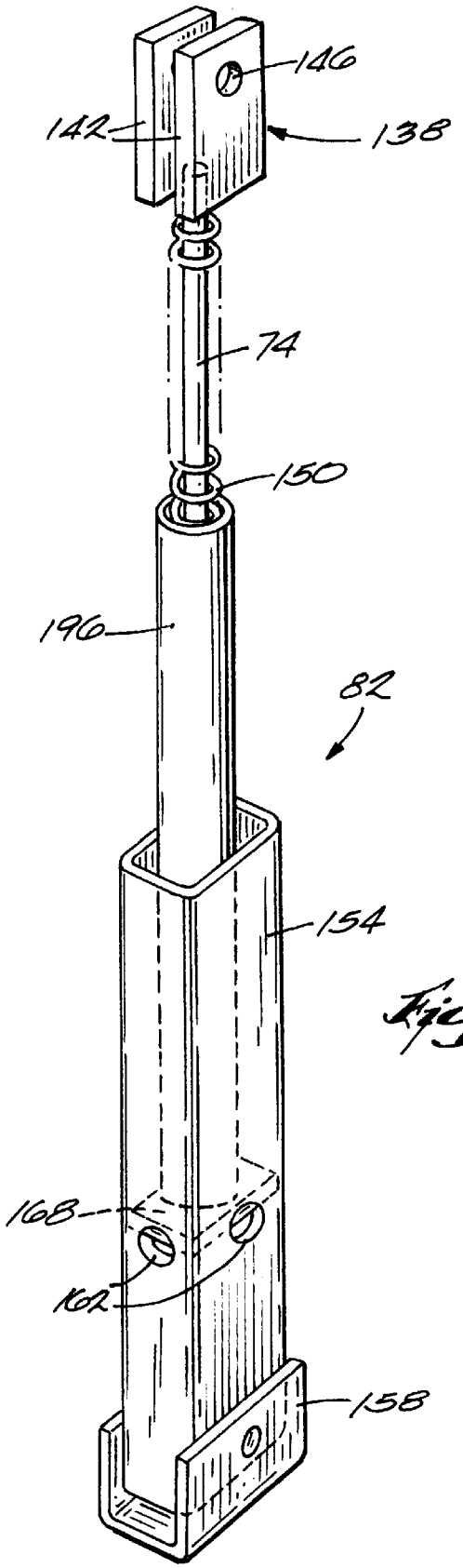
FIG. 5 is a perspective view of a portion of the seal setting mechanism.

The long rod 74 and the short rod 78 are each interconnected to one of the spring assemblies 82. For ease of manufacturing and assembly, the illustrated seal setting mechanism 58 is designed to use the same spring assembly 82 with both the long and short rod 74, 78. The spring assembly 82 illustrated in FIGS. 5 is the one used with the short rod 78, and the one illustrated in FIGS. 4 and 6–9 is the one used with the long rod 74. The spring assembly 82 includes a spring 150, a foot tube 154, and a connecting plate 158.

The illustrated foot tube 154 is a steel tube having ⅛ inch thick walls and a rectangular cross-section. The foot tube 154 extends through one of the guide tubes 50 in the bottom rail 42, and is movable within the guide tubes 50 in a longitudinal direction. The foot tube 154 includes at least one large aperture 162 approximately halfway between its top and bottom edges, and a small aperture 166 adjacent the bottom edge of the tube 154. In the preferred embodiment, the large aperture 162 is a one inch diameter hole drilled through the foot tube walls, and the small aperture 166 is a one-half inch diameter hole drilled through the foot tube walls. Large apertures 162 may be provided in all four walls of the foot tube 154.

A spring plate 168 is disposed within the foot tube 154 adjacent the large aperture 162. The large aperture 162 in the foot tube 154 allows access for welding the spring plate 168 to the foot tube walls. The spring plate 168 includes a centrally-disposed aperture 172 through which the rod 74 or 78 is inserted. The aperture 172 includes an angled portion 176 (FIG. 8) to facilitate insertion of the rod 74 or 78. Preferably, the spring plate 168 is a ⅜ inch thick steel plate, and the centrally-disposed aperture 172 is a slightly over one-half inch diameter drilled hole.

The illustrated spring 150 is a twenty inch helical compression spring. In its normal operating position, the spring 150 rests on the spring plate 168, which provides a bearing surface against which the spring 150 is compressed. The spring is partially compressed and preloaded to about 200 lbs. each. The rod 74 or 78 extends through the coils of the spring 150 and through the aperture 172 in the spring plate 168. In this regard, the spring plate 168 serves as a guide for longitudinal movement of the rod 74 or 78. After the rod 74 or 78 is extended through the spring 150 and through the spring plate aperture 172, a spring pin 180 may be extended through the spring pin hole 134 to prevent the rod 74 or 78 from being pulled back through the spring plate 168. The large aperture 162 in the foot tube 154 provides access to the rod 74 or 78 so that the spring pin 180 may be easily inserted.

The connecting plate 158 is mounted on the end of the foot tube 154, and is also connected to the sealing member 34. The illustrated connecting plate 158 is a steel U-shaped member having ⅛ inch thick bottom wall and sidewalls. Apertures are formed in the sidewalls to allow a foot pin 184 to pass through the small apertures in the foot tube 154 and thereby secure the foot tube 154 to the connecting plate 158. The bottom wall of the connecting plate 158 includes a plurality of through-holes to accommodate fasteners passing through the sealing member 34. The fasteners thereby secure the sealing member 34 to the connecting plate 158.

A long spring sleeve 188 is provided around the spring 150 on the long rod 74. The long spring sleeve 188 is longer than the spring 150, and extends from the spring plate 168 above the top end of the spring 150. A compression tube 192 is in telescoping relationship with the long spring sleeve 188, and extends between the top end of the spring 150 to the mounting bracket 138 for the long rod 74. Thus, when the upper cross-member 62 is pivoted downwardly, the spring 150 is further compressed between the compression tube 192 and the spring plate 168.

A short spring sleeve 196 is provided around the spring 150 on the short rod 78. The short spring sleeve 196 extends from the spring plate 168 upwardly above the level of the foot tube 154. The short spring sleeve 196 ensures that the spring 150 is compressed and expanded linearly about the short rod 78. The top end of the spring 150 abuts the mounting bracket 138 for the short rod 78. Thus the spring 150 is compressed between the mounting bracket 138 and the spring plate 168 when the lower cross-member 66 is pivoted downwardly.

Referring to FIG. 10, a latch plate 200 is mounted on the panel 10 adjacent the trailing edge 22, and between the side walls 38. The latch plate 200 includes a plurality of spaced ratchet teeth 201, 202, 203, 204, 205 mounted on or formed integrally with a substantially vertical rail 208. The uppermost ratchet tooth 201 includes a retaining surface that is angled upwardly to an acute angle with respect to the latch plate rail 208. The uppermost ratchet tooth 201 also includes a rounded surface below the retaining surface. The lower ratchet teeth 202–205 include retaining surfaces angled downwardly to an acute angle with respect to the latch plate rail 208, and rounded surfaces above the retaining surfaces.

The free end 90 of the upper cross-member 62 extends to the latch plate 200, and rests on the retaining surface of one of the uppermost ratchet tooth 201 when the seal setting mechanism 58 is the up position (shown in solid lines in FIG. 10). One of the beveled surfaces 106 of the upper cross-member 62 fits against the retaining surface to ensure the upper cross-member 62 will not inadvertently slip out of this position.

The seal setting mechanism 58 may be moved to the down position by inserting the lever arm 114 into the handle socket 110, unlatching the free end 90 from the top ratchet tooth 201, and pivoting the upper cross-member 62 downwardly. Such downward pivoting movement causes the long and short rods 74, 78 to move downwardly, thereby causing the foot tubes 154 to slide downwardly in the guide tubes 50, and causing the sealing member 34 to move downwardly toward the floor 14 (shown in phantom in FIG. 10). Continued downward pivoting movement of the upper cross-member 62 causes the sealing member 34 to press against the floor 14, and the springs 150 to compress against the spring plates 168 while the long and short rods 74, 78 slide through the centrally-disposed aperture 172.

Once the springs 150 have been compressed the desired amount, the upper cross-member 62 is moved under one of the lower ratchet teeth 202–205 such that one of the beveled surfaces 106 contacts the ratchet tooth's retaining surface to ensure the upper cross-member 62 will not inadvertently slip out of this position (shown in phantom in FIG. 10). The lever 114 may then be removed from the handle socket 110, and the springs 150 will force the free end 90 of the upper cross-member 62 against the retaining surface of the ratchet tooth 204. Thus, the sealing member 34 is held against the floor 114 at a desired force provided by the springs 150.

It should be noted that the mounting brackets 138 for the long and short rods 74, 78 are positioned such that the same downward force is applied to the sealing a member 34 through both springs 150. More specifically, the mounting bracket 138 for the long rod 74 is disposed the same distance from the upper cross-member pivot point 86 as the mounting bracket 138 for the short rod 78 is disposed from the lower cross-member pivot point 118. Also, the mounting brackets 138 for the long and short rods 74, 78 are disposed the same distance from the respective pivot points of the linking member 70 on the upper and lower cross-members 62, 66.

Also, the present invention allows the operator to use his or her weight to assist in moving the seal setting mechanism 158 to the down position. In this regard, the invention provides a weight transfer seal setting mechanism. The seal setting mechanism does not transfer all of the weight of the panel to the floor, and in this regard is a partial-weight transfer or substantial weight transfer seal setting mechanism. In the illustrated embodiment, the springs 150 are preloaded. For a typical wall panel, about 100 pounds per foot is transferred to the floor. For a large panel weighing about 1000–1200 lbs., an average of about 400 lbs. is transferred to the floor when the seal setting mechanism is moved to the second or third lower tooth 202, 203.

A partition wall is easily set up by moving a first panel 10 to a desired location, inserting the lever 114 into the handle socket 110, unlatching and leaning down on the lever 114 to set the sealing member 34 in the down position. Then the next panel 10 is positioned adjacent the first panel 10 and the seal for that panel is set in the down position. This is repeated until the partition wall is set up. Much of the physical labor required in setting up the wall is removed because the operator may use his or her weight to set the sealing mechanism 158.

Although particular embodiments of the present invention have been shown and described, other alternative embodiments will be apparent to those skilled in the art and are within the intended scope of the present invention. Thus, the present invention is to be limited only by the following claims.

What is claimed is:

1. A partition wall panel assembly comprising:

a partition wall panel including opposite walls, said opposite walls each having a lower end disposed near a floor surface; and a seal setting mechanism carried by said partition wall panel and positioned between said opposite walls, said seal setting mechanism including:

first and second cross-members pivotally interconnected with said partition wall panel said first and second cross-members being piovotally interconnected;

a first force transfer member pivotally interconnected to and extending downwardly from said first cross-member;

a second force transfer member pivotally interconnected to and extending downwardly from said second cross-member; and a sealing member interconnected with said first and second force transfer members;

whereby when said cross-members are pivoted, said seal setting mechanism causes said first and second force transfer members to move said sealing member between a first position, in which said sealing member is held away from the floor surface, and a second position, in which said sealing member is held against the floor surface to thereby secure said partition wall panel with respect to the floor surface.

2. The partition wall panel assembly of claim 1, wherein said first position is an up position with respect to the floor surface and said second position is a down position with respect to the floor surface.

3. The partition wall panel assembly of claim 1, wherein said first cross-member is disposed above said second cross-member.

4. The partition wall panel assembly of claim 3, wherein said first cross-member is longer than said second cross-member.

5. The partition wall panel assembly of claim 4, wherein said second cross-member is linked to said first cross-member in the middle of said first cross-member.

6. The partition wall panel assembly of claim 1, wherein said partition wall panel includes a leading edge and a trailing edge, and wherein said first cross-member is pivotally interconnected to the panel adjacent the leading edge, and wherein said second cross-member is pivotally interconnected to the panel adjacent the trailing edge.

7. The partition wall panel assembly of claim 1, wherein said first and second cross-members are substantially parallel to one another when said seal setting mechanism is between said first and second positions.

8. The partition wall panel assembly of claim 1, wherein said seal setting mechanism further includes a linking member that is pivotally interconnected with both said first cross-member and with said second cross-member, wherein said linking member is disposed substantially vertically when said seal setting mechanism is between said first position and said second position.

9. The partition wall panel assembly of claim 8, wherein said linking member interconnects an end of said second cross-member with the middle of said first cross-member.

10. The partition wall panel assembly of claim 1, wherein said seal setting mechanism further includes a first spring surrounding a portion of said first force transfer member and a second spring surrounding a portion of said second transfer member.

11. The partition wall panel assembly of claim 10, wherein said seal setting mechanism further includes:

a first spring plate defining an aperture through which said first force transfer member extends; and a second spring plate defining an aperture through which said second force transfer member extends;

wherein said first spring abuts said first spring plate and said second spring abuts said second spring plate, wherein movement of said seal setting mechanism toward said second position causes said first and second force transfer members to pass through said apertures in said first and second spring plates, respectively, and causes said first and second springs to compress against said first and second spring plates, respectively.

12. A partition wall panel assembly comprising:

a partition wall panel including opposite walls, said opposite walls each having a lower end disposed near a floor surface; and a seal setting mechanism carried by said partition wall panel and positioned between said opposite walls, said seal setting mechanism including:

a cross-member pivotally interconnected with said partition wall panel;

a first force transfer member pivotally interconnected to and extending downwardly from said cross-member;

a second force transfer member pivotally interconnected to and extending downwardly from said cross-member;

a sealing member interconnected with said first and second force transfer members, whereby when said cross-member is pivoted, said seal setting mechanism causes said first and second force transfer members to move said sealing member between a first position, in which said sealing member is held away from the floor surface, and a second position, in which said sealing member is held against the floor surface to thereby secure said partition wall panel with respect to the floor surface; and a latch plate mounted on said partition wall panel, said latch plate including a first tooth having a retaining surface and a second tooth having a retaining surface;

wherein said cross-member abuts said retaining surface of said first tooth when said seal setting mechanism is in said first position, and said cross-member abuts said retaining surface of said second tooth when said seal setting mechanism is in said second position.

13. The partition wall panel assembly of claim 12, further comprising a spring, said spring being compressed by said cross-member when said seal setting mechanism is moved to said second position, said spring forcing said cross-member against said retaining surface of said second tooth and forcing said sealing member against the floor surface when said seal setting mechanism is in said second position.

14. The partition wall panel assembly of claim 1, further comprising a first spring and a second spring, said first spring biasing said sealing member against the floor surface when said seal setting mechanism is in said second position.

15. The partition wall panel assembly of claim 1, further comprising a spring that is compressed between said first cross-member and said sealing member when said sealing mechanism is in said first position.

16. The partition wall panel assembly of claim 1, wherein said seal setting mechanism transfers at least some of the weight of said partition wall panel to the floor surface.

17. A seal setting mechanism for use with a partition wall panel disposed adjacent a surface, the seal setting mechanism comprising:

first and second cross-members adapted to be pivotally interconnected with the panel;

a linking member linking said second cross-member to said first cross-member in the middle of said first cross-member;

a first force transfer member pivotally interconnected to and extending downwardly from said first cross-member;

a second force transfer member pivotally interconnected to and extending downwardly from said second cross-member; and a sealing member interconnected with said first and second force transfer members;

whereby when said cross-members are pivoted, said seal setting mechanism is adapted to cause said first and second force transfer members to move said sealing member between a first position, in which said sealing member is held away from the surface, and a second position, in which said sealing member is held against the surface to thereby secure the panel with respect to the surface.

18. A seal setting mechanism for use with a partition wall panel disposed adjacent a surface, the seal setting mechanism comprising:

first and second cross-members adapted to be pivotally interconnected with the panel;

a linking member pivotally interconnected with both said first cross-member and with said second cross-member;

a first force transfer member pivotally interconnected to and extending downwardly from said first cross-member;

a second force transfer member pivotally interconnected to and extending downwardly from said second cross-member; and a sealing member interconnected with said first and second force transfer members;

whereby when said cross-members are pivoted, said seal setting mechanism is adapted to cause said first and second force transfer members to move said sealing member between a first position, in which said sealing member is held away from the surface, and a second position, in which said sealing member is held against the surface to thereby secure the panel with respect to the surface, said linking member being disposed substantially vertically when said seal setting mechanism is between said first position and said second position.

19. A seal setting mechanism for use with a partition wall panel disposed adjacent a surface, the seal setting mechanism comprising:

first and second cross-members adapted to be pivotally interconnected with the panel;

a linking member pivotally interconnecting an end of said second cross-member with the middle of said first cross-member;

a first force transfer member pivotally interconnected to and extending downwardly from said first cross-member;

a second force transfer member pivotally interconnected to and extending downwardly from said second cross-member; and a sealing member interconnected with said first and second force transfer members;

whereby when said cross-members are pivoted, said seal setting mechanism is adapted to cause said first and second force transfer members to move said sealing member between a first position, in which said sealing member is held away from the surface, and a second position, in which said sealing member is held against the surface to thereby secure the panel with respect to the surface.

* * * * *